US009316946B2

(12) United States Patent
Ohgoshi

(10) Patent No.: US 9,316,946 B2
(45) Date of Patent: Apr. 19, 2016

(54) TONER CARTRIDGE AND IMAGE FORMING APPARATUS INCLUDING THE SAME

(71) Applicant: SHARP KABUSHIKI KAISHA, Osaka-shi, Osaka (JP)

(72) Inventor: Toshihide Ohgoshi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/476,981

(22) Filed: Sep. 4, 2014

(65) Prior Publication Data

US 2015/0212452 A1 Jul. 30, 2015

(30) Foreign Application Priority Data

Jan. 27, 2014 (JP) ..... 2014-012797

(51) Int. Cl.
*G03G 15/08* (2006.01)

(52) U.S. Cl.
CPC ..... *G03G 15/0879* (2013.01); *G03G 15/0865* (2013.01); *G03G 2215/0802* (2013.01)

(58) Field of Classification Search
CPC ..... G03G 15/0875; G03G 15/0891
See application file for complete search history.

(56) References Cited

U.S. PATENT DOCUMENTS 5,128,724 A * 7/1992 Hayashi ..... G03G 21/105 399/119
7,263,317 B2 * 8/2007 Kubota ..... G03G 15/0868 399/258
2005/0175376 A1 * 8/2005 Sekiguchi ..... G03G 15/0886 399/258
2005/0207796 A1 * 9/2005 Ishiguro ..... G03G 15/0868 399/258
2008/0019730 A1 * 1/2008 Yoon ..... G03G 15/0886 399/106
2008/0056772 A1 * 3/2008 Utsumi ..... G03G 15/0893 399/254
2008/0170887 A1 * 7/2008 Nishimura ..... G03G 15/0896 399/262
2008/0170888 A1 * 7/2008 Eto ..... G03G 15/0868 399/263
2008/0170889 A1 * 7/2008 Eto ..... G03G 15/0877 399/263
2008/0170890 A1 * 7/2008 Nishimura ..... G03G 15/0868 399/263
2008/0175629 A1 * 7/2008 Eto ..... G03G 15/087 399/262
2009/0162107 A1 * 6/2009 Yoshikawa ..... G03G 15/0877 399/263

(Continued)

FOREIGN PATENT DOCUMENTS

JP 2000-214667 A 8/2000
JP 2011064827 A * 3/2011
JP 2014191150 A * 10/2014

*Primary Examiner* — David Bolduc
(74) *Attorney, Agent, or Firm* — Birch, Stewart, Kolasch & Birch, LLP

(57) ABSTRACT

There are provided a toner cartridge capable of suppressing generation of an aggregation or a lump of toner which may occur near a toner discharging port depending on toner keeping situation as well as capable of discharging a stable quantity of toner from the toner discharging port, and an image forming apparatus including the same. In a toner cartridge, a cover member is disposed so as to cover a part of an outer circumferential part of a spiral blade in an auger screw disposed inside a toner container. This cover member is able to move between a first position around the spiral blade and a second position, which is separated from the first position, on the opposite side to a toner discharging port across the spiral blade.

8 Claims, 12 Drawing Sheets

(56) References Cited

U.S. PATENT DOCUMENTS

2010/0329747 A1* 12/2010 Kouda ..... G03G 15/0877 399/262
2011/0002715 A1* 1/2011 Ishiguro ..... G03G 15/0875 399/263
2011/0064481 A1* 3/2011 Ishiguro ..... G03G 15/0875 399/263
2011/0229209 A1* 9/2011 Takaya ..... G03G 15/0844 399/257
2012/0027467 A1* 2/2012 Okuda ..... G03G 15/0875 399/262
2013/0251412 A1* 9/2013 Okamoto ..... G03G 15/0877 399/258
2014/0050502 A1* 2/2014 Tsuritani ..... G03G 15/0832 399/90
2014/0161491 A1* 6/2014 Fukushima ..... G03G 21/1633 399/260
2014/0356004 A1* 12/2014 Tsuritani ..... G03G 15/0865 399/12

* cited by examiner

TONER CARTRIDGE AND IMAGE FORMING APPARATUS INCLUDING THE SAME

CROSS-REFERENCE TO RELATED APPLICATION

This application claims priority to Japanese Patent Application No. 2014-012797, which was filed on Jan. 27, 2014, the contents of which are incorporated herein by reference in its entirety.

BACKGROUND OF THE TECHNOLOGY

1. Field of the Technology

The present technology relates to a toner cartridge used so as to be detachably attached to an image forming apparatus such as a laser printer and a multi-functional peripheral and an image forming apparatus including the same.

2. Description of the Related Art

An image forming apparatus using an electrostatic electrophotographic system generally includes respective steps of charging, exposure, developing, transferring, cleaning, charge removing, and fixing. At a step of forming an image, for example, a surface of a photoreceptor, which is rotationally driven, is uniformly charged by a charging device and the charged surface of the photoreceptor is irradiated with laser beam by an exposure device, so that an electrostatic latent image is formed. Subsequently, the electrostatic latent image on the photoreceptor is developed by a developing device, so that a toner image is formed on the surface of the photoreceptor. The toner image on the photoreceptor is transferred onto a printing sheet of paper by a transfer device and thereafter the toner image is fixed on the printing sheet of paper by being heated by a fixing device. Further, residual toner which remains on the surface of the photoreceptor after transferring is removed by a cleaning device and collected in a predetermined collecting section while the surface of the photoreceptor after being cleaned has residual electric charge removed by a charge removing device to prepare for next image formation.

As developer with which an electrostatic latent image on a photoreceptor is developed, one-component developer composed of only toner or two-component developer composed of toner and carrier is used. The one-component developer does not need an agitating mechanism for mixing toner and carrier uniformly and the like due to no use of carrier, and thus has an advantage such that a configuration of a developing device is simplified, however, has a disadvantage such that a charging amount of toner is hard to be stabilized due to no use of carrier, and the like. The two-component developer needs the agitating mechanism for mixing toner and carrier uniformly and the like and thus has a disadvantage such that a developing device is complicated, however, is often used for an image forming apparatus for high-speed printing and a color image forming apparatus because of having excellent stability of a charging amount and adaptability to high-speed printing.

In the case of performing image formation using the two-component developer, toner contained in a toner cartridge is automatically supplied to a developing device from a discharging port after toner inside the developing device is consumed, and thereby image formation is able to be performed successively. The toner cartridge is detachably attached to an apparatus main body of an image forming apparatus and replaced with a new toner cartridge when the contained toner is consumed due to supply to the developing device.

As such a toner cartridge, one shown in FIG. 10 has been proposed. FIG. 10 is a diagram showing a configuration of a toner cartridge 300 according to a first conventional technology. The toner cartridge 300 according to the first conventional technology shown in FIG. 10 includes a toner container 301 having a toner containing space 306 in which toner is contained, an auger screw 303 and a shutter 305. In the toner container 301, a toner discharging port 302*a* for discharging the toner is formed at a bottom wall 301*a* in one longitudinal end side of a container main body which is formed in a cylindrical shape. This toner discharging port 302*a* is opened and closed with the shutter 305. Moreover, the auger screw 303 is disposed inside the toner containing space 306 of the toner container 301 and has a rotation shaft 303*a* supported rotatably on end walls 302 which shut both opening ends of the container main body and a spiral blade 303*b* that encircles the rotation shaft 303*a* and is fixed by the rotation shaft 303*a*. The auger screw 303 conveys the toner contained in the toner container 301 toward the toner discharging port 302*a* by rotation of the spiral blade 303*b* associated with rotation of the rotation shaft 303*a*.

When being attached to the apparatus main body of the image forming apparatus, the toner cartridge 300 according to the first conventional technology is able to replenish the toner to the developing device by discharging the toner conveyed by the auger screw 303 from the toner discharging port 302*a*.

However, in the toner cartridge 300 according to the first conventional technology, toner existing on an upper side of the auger screw 303 also flows into the toner discharging port 302*a* together with the toner conveyed in an axial direction by the auger screw 303, so that there is a problem that a quantity of the toner discharged from the toner discharging port 302*a* is not stabilized.

As a toner cartridge for solving such a problem, one shown in FIG. 11 has been proposed. FIG. 11 is a diagram showing a configuration of a toner cartridge 400 according to a second conventional technology. The toner cartridge 400 according to the second conventional technology shown in FIG. 11 includes a toner container 401 having a toner containing space 406 in which toner is contained, a toner discharging section 404 which is disposed in a vicinity of a toner discharging port 402*a* formed at a bottom wall 401*a* in one longitudinal end side of the toner container 401 and has a configuration of extending from the toner container 401, an auger screw 403 and a shutter 405. The toner discharging port 402*a* arranged in the toner discharging section 404 is opened and closed with the shutter 405. Moreover, the auger screw 403 is disposed inside the toner containing space 406 of the toner container 401 and inside the toner discharging section 404, and has a rotation shaft 403*a* supported rotatably on end walls 402 which shut both opening ends of the toner container 401 and a spiral blade 403*b* that encircles the rotation shaft 403*a* and is fixed by the rotation shaft 403*a*. The auger screw 403 conveys toner contained in the toner container 401 toward the toner discharging port 402*a* via the toner discharging section 404 by rotation of the spiral blade 403*b* associated with rotation of the rotation shaft 403*a*.

When being attached to an apparatus main body of an image forming apparatus, the toner cartridge 400 according to the second conventional technology is able to replenish toner to a developing device by discharging the toner conveyed by the auger screw 403 from the toner discharging port 402*a* arranged in the toner discharging section 404. Furthermore, since the toner discharging port 402*a* from which toner is discharged is arranged in the toner discharging section 404 which has small toner containing space capacity, the toner cartridge 400 according to the second conventional technology is able to suppress that toner existing on an upper side of the auger screw 403 flows into the toner discharging port 402*a*, making it possible to stabilize a quantity of the toner discharged from the toner discharging port 402*a*.

In addition, as one similar to the toner cartridge 400 according to the second conventional technology, for example, one described in Japanese Unexamined Patent Publication JP-A 2000-214667 has been proposed.

In a case where the toner cartridge 400 according to the second conventional technology shown in FIG. 11 is kept in a state of being upright with a toner discharging port 402*a* side facing downward, toner in the toner container 401 comes down by its own weight with lapse of time and toner density near the toner discharging port 402*a* becomes high. As a result of this, a problem is caused that the toner near the toner discharging port 402*a* aggregates and further becomes a lump to shut the toner discharging port 402*a*. Note that, also depending on vibrations and a loading situation at a time of transport of the toner cartridge 400, it may occur that the toner density near the toner discharging port 402*a* becomes high to cause an aggregation.

In the case of attaching the toner cartridge 400 whose toner discharging port 402*a* is shut by such an aggregation or a lump of the toner to the apparatus main body of the image forming apparatus, the toner is difficult to be discharged from the toner cartridge 400, and it may occur that judgment of exhaustion of toner is made in an apparatus main body side even though a large quantity of toner remains inside the toner cartridge 400. Moreover, failure that the aggregation or the lump of the toner near the toner discharging port 402*a* is compressed and hardened by pressure of the auger screw 403, resulting that the auger screw 403 is locked, may occur as well.

Moreover, the toner cartridge described in JP-A 2000-214667 is configured to reduce pressure on toner in a toner discharging port side by an auger screw at a time of toner conveyance for preventing aggregating of toner by cutting a part of a spiral blade of the auger screw in the toner discharging port side. However, the toner cartridge described in JP-A 2000-214667 is not able to cope with aggregating of toner which occurs in the case of being kept in the state of being upright with the toner discharging port side facing downward.

SUMMARY OF THE TECHNOLOGY

An object of the technology is to provide a toner cartridge capable of suppressing generation of an aggregation or lump of toner which may occur near a toner discharging port depending on toner keeping situation as well as capable of discharging a stable quantity of toner from the toner discharging port, and an image forming apparatus including the same.

The technology provides a toner cartridge which is detachably attached to a main body of an image forming apparatus, comprising:

a toner container having a cylindrical container main body for containing toner, in the toner container a toner discharging port for discharging the toner to an outside being formed at one longitudinal end thereof, and end walls for shutting opening ends of the container main body, respectively;

a toner conveyance member disposed inside the container main body of the toner container, the toner conveyance member extending along a longitudinal direction of the container main body, having a rotation shaft rotatably supported on the end walls and a spiral blade that encircles the rotation shaft and is fixed by the rotation shaft, and conveying the toner contained inside the container main body toward the toner discharging port by rotation of the spiral blade associated with rotation of the rotation shaft; and a cover member which is disposed to be in contact with an outer circumferential part of the spiral blade so as to cover a part of the outer circumferential part of the spiral blade and which is able to move between a first position around the spiral blade and a second position, which is separated from the first position, on an opposite side to the toner discharging port across the spiral blade, when the toner cartridge is not attached to the main body of the image forming apparatus, the cover member being arranged at the first position, and after the toner cartridge is attached to the main body of the image forming apparatus, the cover member moving from the first position to the second position by rotation of the spiral blade.

Moreover, in the toner cartridge of the technology, it is preferable that the second position is a position which is separated from the first position in an axial direction of the spiral blade around the spiral blade, and the cover member moves from the first position to the second position by moving along the axial direction of the spiral blade in association with the rotation of the spiral blade after the toner cartridge is attached to the main body of the image forming apparatus.

Moreover, in the toner cartridge of the technology, it is preferable that the cover member has a plate-shaped base section which covers a part of the spiral blade and a projecting section which protrudes inwardly in a radial direction of the spiral blade from the base section, and to which a force along the axial direction is applied due to contact with the spiral blade when the spiral blade rotates, and the spiral blade has a cutout formed in a part thereof which corresponds to the projecting section of the cover member which has moved to the second position.

Moreover, in the toner cartridge of the technology, it is preferable that the cover member has a plate-shaped base section which covers a part of the spiral blade and a projecting section which protrudes inwardly in a radial direction of the spiral blade from the base section, and to which a force along the axial direction is applied due to contact with the spiral blade when the spiral blade rotates, and an outer diameter of a part of the spiral blade which corresponds to the projecting section of the cover member which has moved to the second position is smaller than an outer diameter of other part of the spiral blade.

Moreover, in the toner cartridge of the technology, it is preferable that the second position is a position which is separated from the first position in a circumferential direction of the spiral blade around the spiral blade, and the cover member moves from the first position to the second position by rotating in association with the rotation of the spiral blade after the toner cartridge is attached to the main body of the image forming apparatus.

Moreover, in the toner cartridge of the technology, it is preferable that the cover member has a plate-shaped base section which covers a part of the spiral blade, a cylindrical section which continues to an end of the base section on another longitudinal end side of the container main body and which externally surrounds the spiral blade, and a projecting section which protrudes outwardly in an axial direction of the spiral blade from the cylindrical section and to which a force along the circumferential direction is applied due to contact with the spiral blade when the spiral blade rotates, the spiral blade has a blade projecting section formed in a part thereof which corresponds to the projecting section of the cover member disposed at the first position, and in one of the end walls which shuts one of the opening ends on one longitudinal end side of the container main body, a step is formed on which an end of the base section in the cover member which end is on a side opposite to a side of the base section to be connected to the cylindrical section when the cover member is moved to the second position is mounted.

Moreover, in the toner cartridge of the technology, it is preferable that the cover member is formed of a flexible material.

Moreover, the technology provides an image forming apparatus, comprising:

a photoreceptor drum on a surface of which an electrostatic latent image is to be formed;

a developing device which supplies toner to the electrostatic latent image formed on the surface of the photoreceptor drum to develop a toner image;

the toner cartridge mentioned above, the toner cartridge replenishing toner to the developing device;

a transfer device which transfers the toner image developed on the surface of the photoreceptor drum onto a recording sheet of paper; and a fixing device which fixes a transferred toner image onto the recording sheet of paper.

According to the technology, the cover member which is in contact with the outer circumferential part of the spiral blade is disposed so as to cover the part of the outer circumferential part of the spiral blade in the toner conveyance member disposed inside the toner container. This cover member is able to move between the first position around the spiral blade and the second position, which is separated from the first position, on the opposite side to the toner discharging port across the spiral blade. When the toner cartridge is not attached to the main body of the image forming apparatus, the cover member is arranged at the first position, and after the toner cartridge is attached to the main body of the image forming apparatus, the cover member moves from the first position to the second position by the rotation of the spiral blade.

In the toner cartridge according to the technology, which is configured as described above, the cover member is arranged at the first position being separated from the second position which is on the opposite side to the toner discharging port across the spiral blade when the toner cartridge is not attached to the apparatus main body of the image forming apparatus, thus making it possible to increase toner containing space capacity in a vicinity of the toner discharging port. As a result thereof, even in a case where the toner cartridge is kept in the state of being upright with the toner discharging port side facing downward, it is possible to suppress generation of an aggregation or a lump of toner in the vicinity of the toner discharging port.

Furthermore, in the toner cartridge of the technology, when the toner cartridge is attached to the apparatus main body of the image forming apparatus, the cover member is moved from the first position to the second position which is on the opposite side to the toner discharging port across the spiral blade by the rotation of the spiral blade. Thereby, it is possible to suppress by the cover member that toner existing on an upper side of the toner conveyance member inside the toner container flows into the toner discharging port, so that a quantity of toner discharged from the toner discharging port is able to be stabilized.

Moreover, according to the technology, by providing the toner cartridge described above, it is possible to suppress occurrence of a malfunction at a time of exchanging toner cartridges and realize an image forming apparatus in which deterioration of image quality is prevented.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
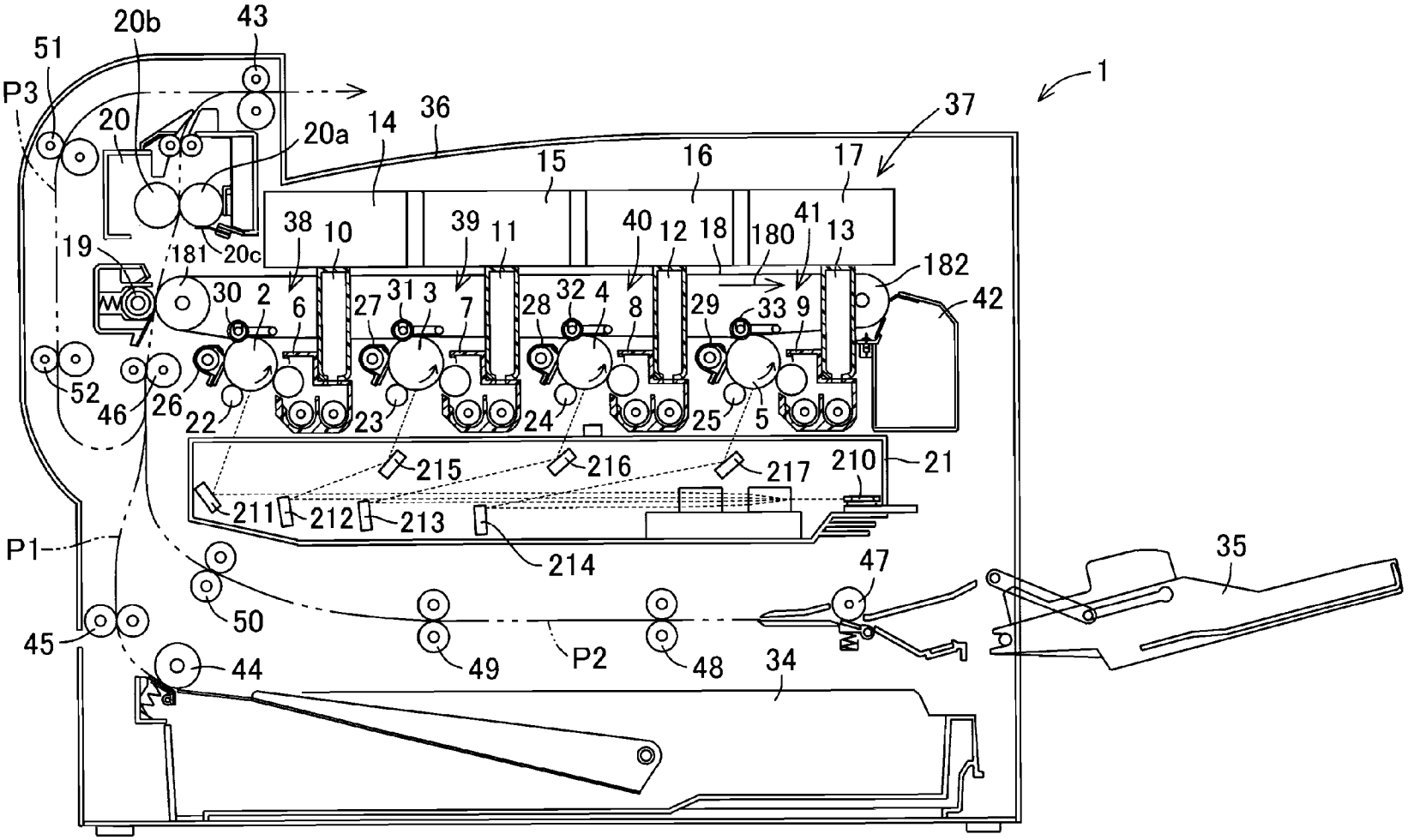
FIG. 1 is a schematic view showing an entire configuration of an image forming apparatus according to one embodiment of the technology.

Now referring to the drawings, preferred embodiments of the technology are described below.

Description will hereinafter be given for modes for carrying out the technology with reference to drawings. FIG. 1 is a schematic view showing an entire configuration of an image forming apparatus 1 according to one embodiment of the technology. The image forming apparatus 1 according to the present embodiment includes, as shown in FIG. 1, photoreceptor drums 2 to 5 on surfaces of which electrostatic latent images are to be formed, developing devices 6 to 9 that form toner images by supplying toner to the electrostatic latent images on the surfaces of the photoreceptor drums 2 to 5, toner cartridges 14 to 17 that replenish toner to the developing devices 6 to 9 via toner replenishing pipes 10 to 13 as toner replenishing members, a secondary transfer roller 19 as a transfer device that transfers the toner images on the surfaces of the photoreceptor drums 2 to 5 onto a sheet of paper via an intermediate transfer belt 18 and a fixing device 20 that fixes the toner images to the sheet of paper, and forms an image using toner by an electrophotographic system. In addition, the toner cartridges 14 to 17 used for this image forming apparatus 1 are characterized by having a specific configuration as described below.

The image forming apparatus 1 according to the embodiment forms an image having a multiple color as a visible image on a predetermined sheet (a recording sheet of paper) as a recording medium based on image data included in an input command, such as image data transmitted from outside via a communication network or the like. As shown in FIG. 1, this image forming apparatus 1 is provided with an exposure unit 21, the photoreceptor drums 2 to 5 corresponding to image bearing members having latent images formed by the exposure unit 21, the developing devices 6 to 9, charging rollers 22 to 25, cleaning units 26 to 29, the intermediate transfer belt 18, primary transfer rollers 30 to 33, the secondary transfer roller 19, the fixing device 20, paper conveyance paths P1, P2 and P3, a paper feeding cassette 34, a manual paper feeding tray 35, a catch tray 36, a toner cartridge unit 37, and the like.

Image data of a color image handled in this image forming apparatus 1 forms a visible image in image forming sections 38 to 41 by using image data corresponding to each of four colors of black (K), cyan (C), magenta (M) and yellow (Y). The image forming sections 38 to 41 correspond to a color image using the respective colors. Accordingly, the charging rollers 22 to 25, the photoreceptor drums 2 to 5 and the developing devices 6 to 9 are respectively provided in four sets so as to form four types of latent images and toner images in accordance with the respective colors, and the cleaning units 26 to 29 and the primary transfer rollers 30 to 33 are also provided in four sets so as to correspond thereto. Each of the image forming sections 38 to 41 has the same configuration, and for example, the black image forming section 38 is configured by the photoreceptor drum 2, the developing device 6, the charging roller 22, the transfer roller 30, the cleaning unit 26 and the like.

These image forming sections 38 to 41 are arranged in a line along a moving direction of the intermediate transfer belt 18 (sub-scanning direction). Note that, in the image forming sections 38 to 41, reference numerals 38, 39, 40 and 41 correspond to black, cyan, magenta and yellow, respectively, and four image stations are configured by the respective sections described above that are distinguished from each other by these reference numerals.

The exposure unit 21 which is an exposure device includes a semiconductor laser as a not-shown laser light source, a polygon mirror 210, first reflection mirrors 211 to 214, second reflection mirrors 215 to 217 and the like, and emits respective optical beams such as laser beams modulated by image data of respective colors of black, cyan, magenta and yellow to the photoreceptor drums 2 to 5, respectively. Electrostatic latent images by image data of the respective colors of black, cyan, magenta, and yellow are formed on the photoreceptor drums 2 to 5, respectively.

In the embodiment, the exposure unit 21 is of a type using a laser scanning unit (LSU) provided with a laser emitting section and a reflection mirror, but a type disposing light emitting elements in an array, for example, using an EL or LED writing head may be used.

The photoreceptor drums 2 to 5 are disposed above the exposure unit 21, are image bearing members having a substantially cylindrical shape, and are controlled so as to rotate in a predetermined direction (refer to an arrow attached to each of the photoreceptor drums 2 to 5) by a driving section and a control section, which are not shown. The photoreceptor drums 2 to 5 are configured with a photoconductive layer formed on a conductive substrate. For example, with a metal drum made of aluminum or the like as the substrate, on an outer circumferential surface thereof, the photoconductive layer of amorphous silicon (a-Si), selenium (Se), organic photo-semiconductor (OPC) or the like is formed in a thin film shape. Note that, the configuration of the photoreceptor drums 2 to 5 is not particularly limited to the configuration described above. The charging rollers 22 to 25 are chargers of a contact system which charge the surfaces of the photoreceptor drums 2 to 5 uniformly to predetermined potential. In the embodiment, as shown in FIG. 1, although roller-type charging rollers 22 to 25 of the contact type are used as the chargers, in replacement of such charging rollers 22 to 25, chargers of a charger type or a brush type may be used instead.

The developing devices 6 to 9 supply toner to the surfaces of the photoreceptor drums 2 to 5 on which electrostatic latent images are formed, to develop the electrostatic latent images to toner images. Each of the developing devices 6 to 9 contains toner of the respective colors of black, cyan, magenta and yellow, and visualizes the electrostatic latent image corresponding to each of the colors formed on each of the surfaces of the photoreceptor drums 2 to 5 into the toner image of each of the colors of black, cyan, magenta and yellow. The cleaning units 26 to 29 remove and collect toner remaining on the surfaces of the photoreceptor drums 2 to 5 after development and image transfer with a lubricant or the like.

The intermediate transfer belt 18 arranged above the photoreceptor drums 2 to 5 is supported around a driving roller 181 and a driven roller 182 with tension to form a loop-shaped moving path. The photoreceptor drum 5 (yellow), the photoreceptor drum 4 (magenta), the photoreceptor drum 3 (cyan) and the photoreceptor drum 2 (black) are arranged in this order to face the outer circumferential surface of the intermediate transfer belt 18 along a moving direction 180 thereof. The primary transfer rollers 30 to 33 are arranged at positions facing the respective photoreceptor drums 2 to 5 with the intermediate transfer belt 18 interposed therebetween. The respective positions at which the intermediate transfer belt 18 faces the photoreceptor drums 2 to 5 are primary transfer positions. This intermediate transfer belt 18 is a film having a thickness of about 100 to 150 μm, and formed to be an endless-shape. A primary transfer bias having opposite polarity to charging polarity of toner is applied by constant voltage control to the primary transfer rollers 30 to 33 in order to transfer the toner images carried on the surfaces of the photoreceptor drums 2 to 5 onto the intermediate transfer belt 18. Thereby, the toner images of the respective colors formed on the photoreceptor drums 2 to 5 are transferred and overlaid onto the outer circumferential surface of the intermediate transfer belt 18 sequentially, and a full-color toner image is formed on the outer circumferential surface of the intermediate transfer belt 18.

However, when image data for only a part of the colors of yellow, magenta, cyan and black is inputted, formation of an electrostatic latent image and a toner image is performed at only a part of the photoreceptor drum corresponding to the color of the inputted image data among the four photoreceptor drums 2 to 5. For example, at a time of monochrome image formation, formation of an electrostatic latent image and formation of a toner image are performed only at the photoreceptor drum 2 corresponding to the color of black, and only a black toner image is transferred onto the outer circumferential surface of the intermediate transfer belt 18.

Each of the primary transfer rollers 30 to 33 is configured by coating a surface of a shaft whose raw material is metal (for example, stainless steel) having a diameter of 8 to 10 mm with a conductive elastic material (for example, such as EPDM or urethane foam), and applies high voltage uniformly to the intermediate transfer belt 18 by the conductive elastic material. In the embodiment, although the primary transfer rollers 30 to 33 are used as transfer electrodes, other than them, a brush or the like is also usable. The toner image transferred onto the outer circumferential surface of the intermediate transfer belt 18 at each primary transfer position is conveyed to a secondary transfer position, which is a position facing the secondary transfer roller 19, by rotation of the intermediate transfer belt 18 along the moving direction 180. The secondary transfer roller 19 is in pressure-contact at a predetermined nip pressure with the outer circumferential surface of the intermediate transfer belt 18 whose inner circumferential surface is in contact with a circumferential surface of the intermediate transfer belt driving roller 181 at a time of image formation. To obtain this nip pressure constantly, either of the secondary transfer roller 19 or the intermediate transfer belt driving roller 181 is formed by a hard material such as metal, and the other is formed by a soft material such as an elastic roller (elastic rubber roller, foamed resin roller or the like).

When a sheet of paper fed from the paper feeding cassette 34 or the manual paper feeding tray 35 passes through between the secondary transfer roller 19 and the intermediate transfer belt 18, high voltage with opposite polarity (+) to the charging polarity of the toner (−) is applied to the secondary transfer roller 19. As described above, the electrostatic latent images formed on the surfaces of the respective photoreceptor drums 2 to 5 are visualized by the toner corresponding to the respective colors to become respective toner images, and these toner images are layered on the intermediate transfer belt 18. Thereafter, the layered toner images are moved to a position where the conveyed sheet of paper is in contact with the intermediate transfer belt 18 by the rotation movement of the intermediate transfer belt 18, and by the secondary transfer roller 19 arranged at this position, the toner images are transferred from the outer circumferential surface of the intermediate transfer belt 18 onto the sheet of paper.

Toner adhered to the intermediate transfer belt 18 by the contact of the intermediate transfer belt 18 with the photoreceptor drums 2 to 5, and toner remaining on the intermediate transfer belt 18 without being transferred at a time of transferring the toner image from the intermediate transfer belt 18 to the sheet of paper cause color mixture of the toner at a next step, and are therefore removed and collected by an intermediate transfer belt cleaning unit 42. The intermediate transfer belt cleaning unit 42 is provided with, for example, a cleaning blade as a cleaning member that is in contact with the intermediate transfer belt 18. A part of the intermediate transfer belt 18 with which the cleaning blade is in contact is supported by the intermediate transfer belt driven roller 182 from a back side thereof.

The sheet of paper to which a toner image is transferred as a visible image is guided to the fixing device 20 provided with a heating roller 20*a* and a pressure roller 20*b*, passes through between the heating roller 20*a* and the pressure roller 20*b*, and subjected to heating and pressure processing. Thereby, the toner image to be the visible image is fixed firmly on a surface of the sheet of paper. The sheet of paper on which the toner image is fixed is discharged by a paper discharging roller 43 onto the catch tray 36. The heating roller 20*a* is provided with a temperature sensor (for example, such as thermistor) 20*c*, and based on surface temperature detection information of the heating roller 20*a* by this temperature sensor, heat generation control in a heat generating section of the heating roller 20*a* is performed by the not-shown control section.

The image forming apparatus 1 is provided with the paper conveyance path P1 extending in a substantially vertical direction for sending the sheet of paper contained in the paper feeding cassette 34 to the catch tray 36 through a region between the secondary transfer roller 19 and the intermediate transfer belt 18 and through the fixing device 20. In this paper conveyance path P1, a pick-up roller 44 for feeding the sheet of paper in the paper feeding cassette 34 to the paper conveyance path P1 sheet by sheet, a conveying roller 45 for conveying the fed sheet of paper upward, registration rollers 46 for guiding the conveyed sheet of paper toward between the secondary transfer roller 19 and the intermediate transfer belt 18 at a predetermined timing, and the paper discharging roller 43 for discharging the sheet of paper to the catch tray 36 are arranged. Moreover, inside the image forming apparatus 1, the paper conveyance path P2 on which a pick-up roller 47 and conveying rollers 48 to 50 are arranged is formed between from the manual paper feeding tray 35 and the registration rollers 46. Further, the paper conveyance path P3 is formed between from the paper discharging roller 43 to an upstream side of the registration rollers 46 in the paper conveyance path P1.

The paper discharging roller 43 is rotatable in both forward and reverse directions, and driven in the forward direction to discharge a sheet of paper to the catch tray 36 at a time of single-sided image formation in which an image is formed on one side of the sheet of paper, and at a time of second side image formation in double-sided image formation in which an image is formed on both sides of the sheet of paper. On the other hand, at a time of first side image formation in the double-sided image formation, the paper discharging roller 43 is driven in the forward direction until a tail end of the sheet of paper passes through the fixing device 20, and then driven in the reverse direction to guide the sheet of paper in the paper conveyance path P3 in a state where the tail end of the sheet of paper is held. In the paper conveyance path P3, reverse conveying rollers 51 and 52 are arranged and, by these reverse conveying rollers 51 and 52, the sheet of paper on which an image has been formed only on one side at the time of double-sided image formation is guided from the paper conveyance path P3 to the paper conveyance path P1 in a state having its front and back sides as well as leading and tail ends respectively reversed.

The registration rollers 46 guide a sheet of paper fed from the paper feeding cassette 34 or the manual paper feeding tray 35 or conveyed through the paper conveyance path P3 toward between the secondary transfer roller 19 and the intermediate transfer belt 18 at a timing synchronized with the rotation of the intermediate transfer belt 18. Therefore, the rotation of the registration rollers 46 is stopped when the photoreceptor drums 2 to 5 and the intermediate transfer belt 18 start to operate, and a movement of the sheet of paper fed or conveyed prior to the rotation of the intermediate transfer belt 18 inside the paper conveyance path P1 is stopped in a state where a leading end thereof abuts the registration rollers 46. Thereafter, the registration rollers 46 start rotating at a timing at which the leading end of the sheet of paper faces leading ends of the toner images formed on the intermediate transfer belt 18 at a position where the secondary transfer roller 19 and the intermediate transfer belt 18 come into pressure-contact with each other.

Note that, at a time of full-color image formation in which image formation is performed in all of the image forming sections 38 to 42, the primary transfer rollers 30 to 33 cause the intermediate transfer belt 18 to come into pressure-contact with all of the photoreceptor drums 2 to 5. On the other hand, at a time of monochrome image formation in which image formation is performed only in the image forming section 38, only the primary transfer roller 30 causes the intermediate transfer belt 18 to come into pressure-contact with the photoreceptor drum 2.

Figure 2:
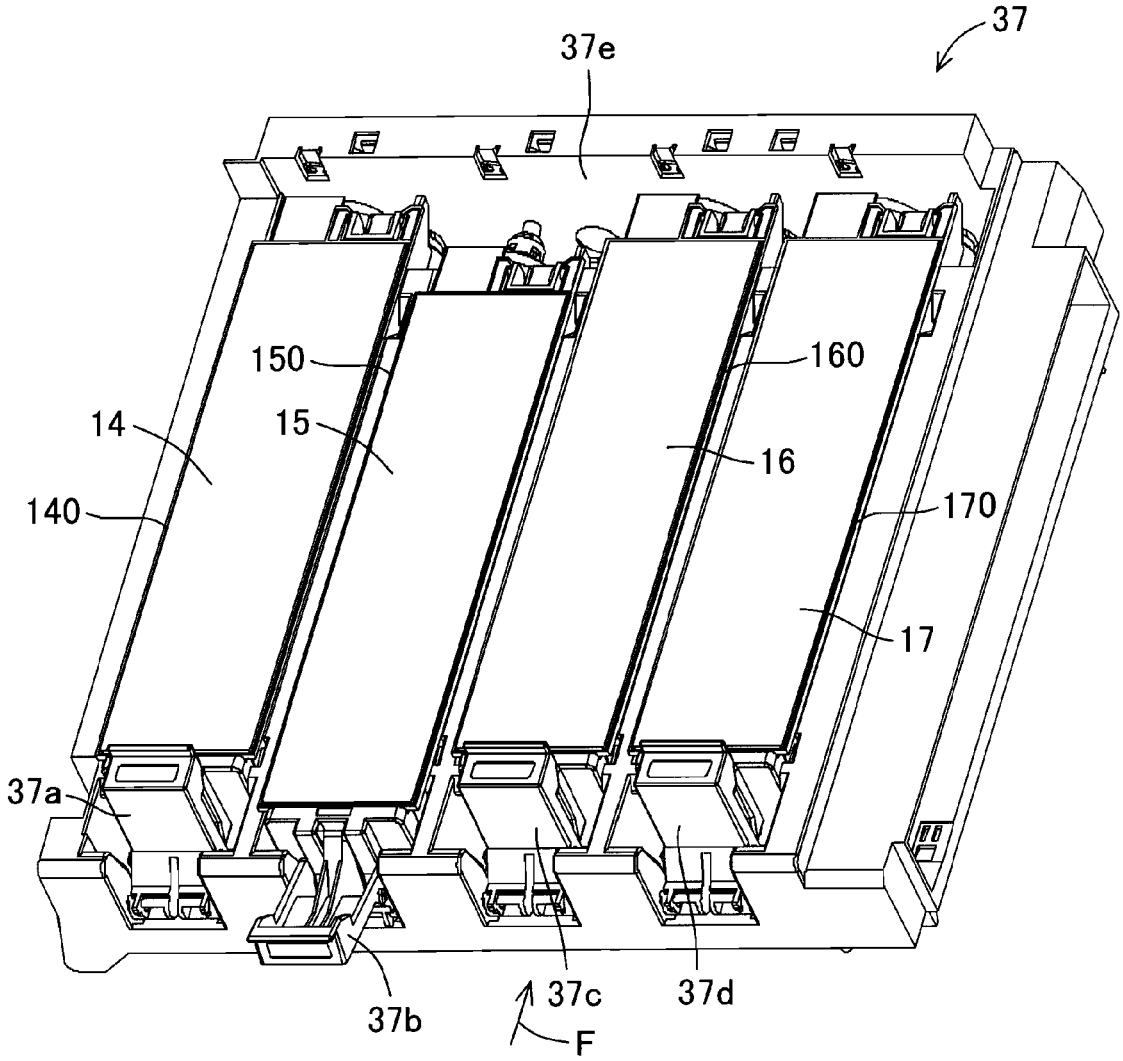
FIG. 2 is a perspective view showing a configuration of the toner cartridge unit in which four toner cartridges are collectively unitized.

Next, description will be given specifically for a configuration of the characteristic toner cartridges 14 to 17 according to the embodiment with reference to the drawings. FIG. 2 is a perspective view showing a configuration of the toner cartridge unit 37 in which the four toner cartridges 14 to 17 are collectively unitized. As to the toner cartridges 14 to 17, as shown in FIG. 2, the four toner cartridges 14 to 17 are disposed side by side on the toner cartridge unit 37. In each of the toner cartridges 14 to 17, by lifting any one of corresponding lock levers 37*a* to 37*d* provided in the toner cartridge unit 37 upward, toner containers 140 to 170 as the toner containers are moved in a direction of an arrow F to be kept in a state of being pressed against a stopper plate 37*e*. In this manner, the toner cartridge unit 37 in which the four toner cartridges 14 to 17 are arranged side by side is installed above the intermediate transfer belt 18. In this installed state, the respective toner containers 140 to 170 are connected to the toner replenishing pipes 10 to 13, so that the respective corresponding toners are replenished to the developing devices 6 to 9 via the toner replenishing pipes 10 to 13. Note that, a state before the cyan toner cartridge 15 is attached is shown in FIG. 2.

Figure 3A:
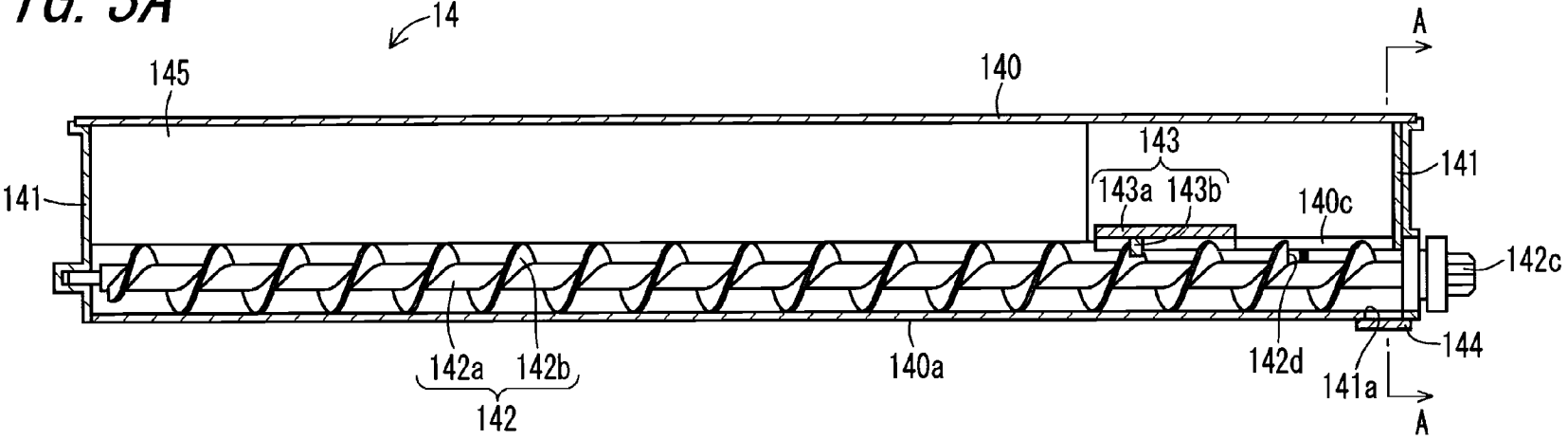
FIG. 3A and FIG. 3B are cross-sectional views of the toner cartridge according to a first embodiment of the technology in a state before attachment of the toner cartridge to the image forming apparatus.
Figure 3B:
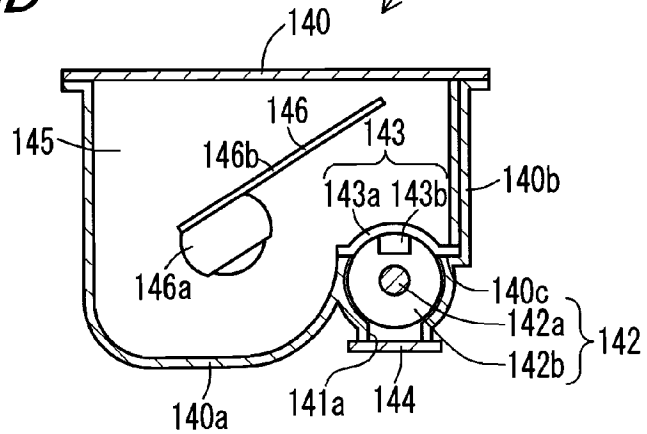
Figure 4A:
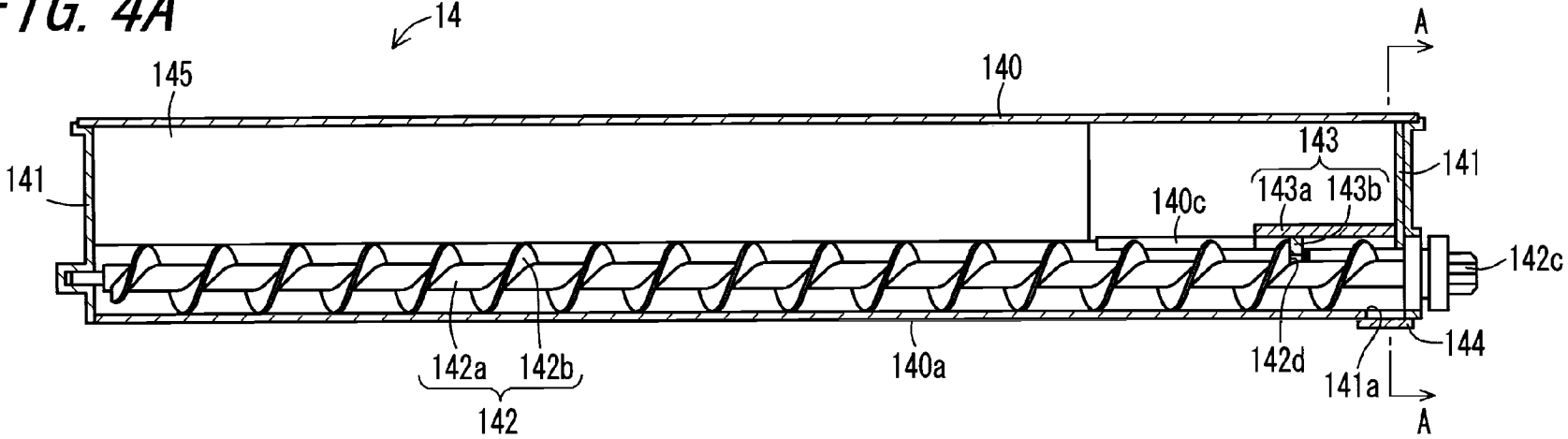
FIG. 4A and FIG. 4B are cross-sectional views of the toner cartridge in a state after attachment of the toner cartridge to the image forming apparatus for driving.
Figure 4B:
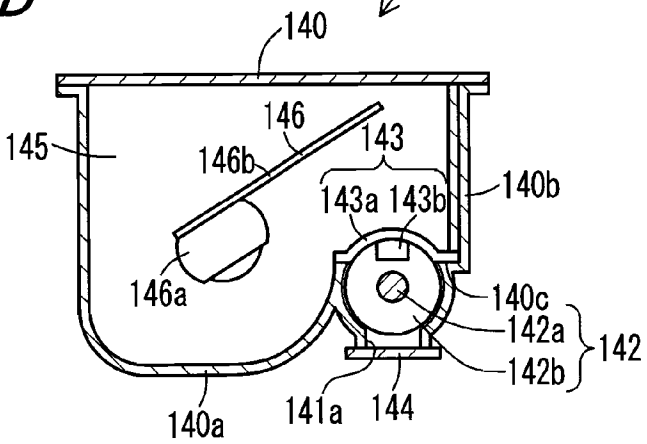

Next, description will be given specifically for a configuration of the toner cartridges 14 to 17 by exemplifying the black toner cartridge 14, with reference to FIG. 3A, FIG. 3B, FIG. 4A and FIG. 4B. Since the other toner cartridges 15 to 17 are configured in the same manner as the black toner cartridge 14, the description thereof will be omitted below. FIG. 3A and FIG. 3B show cross-sectional views of the toner cartridge 14 according to the first embodiment of the technology in a state before attachment of the toner cartridge 14 to the image forming apparatus 1, and FIG. 3A shows a vertical cross-sectional view of the toner cartridge 14 and FIG. 3B shows a lateral cross-sectional view taken along the line A-A of FIG. 3A, FIG. 4A and FIG. 4B show cross-sectional views of the toner cartridge 14 in a state after attachment of the toner cartridge 14 to the image forming apparatus 1 for driving, and FIG. 4A shows a vertical cross-sectional view of the toner cartridge 14 and FIG. 4B shows a lateral cross-sectional view taken along the line A-A of FIG. 4A.

The toner cartridge 14 is provided with the toner container 140 for containing black toner, an auger screw 142 which is provided inside the toner container 140 and functions as a toner conveyance member, and a cover member 143.

The toner container 140 has a longitudinally cylindrical container main body for containing black toner, and end walls 141 for shutting both opening ends of the container main body. A toner discharging port 141*a* for discharging the black toner to the outside is formed at a bottom wall 140*a* of one longitudinal end of the toner container 140. The toner container 140 is provided with a shutter 144 for opening and closing the toner discharging port 141*a*.

The auger screw 142 extends along the longitudinal direction of the toner container 140, and has a rotation shaft 142*a* supported rotatably on the end walls 141 of the toner container 140, and a spiral blade 142*b* that encircles the rotation shaft 142*b* and is fixed by the rotation shaft 142*a*. By the rotation of the spiral blade 142*b* associated with rotation of the rotation shaft 142*a*, the auger screw 142 conveys the black toner contained in a toner containing space 145 of the toner container 140 toward the toner discharging port 141*a*.

In addition, in the toner containing space 145 of the toner container 140, an agitating supply member 146 composed of a rotation shaft 146*a* which is parallel to the rotation shaft 142*a* of the auger screw 142 and a flexible agitating sheet 146*b* which extends outward in a radial direction from the outer circumferential surface of the rotation shaft 146*a* is rotatably supported.

Upon attachment to the image forming apparatus 1, the rotation shaft 142*a* of the auger screw 142 and the rotation shaft 146*a* of the agitating supply member 146 rotate by being applied with rotation driving force from a driving source provided in the image forming apparatus 1.

The agitating supply member 146 has the rectangular agitating sheet 146*b* fixed to a circumferential surface of the rotation shaft 146*a*. The agitating sheet 146*b* is made of a flexible resin sheet, for example, such as polyethylene terephthalate (PET). The agitating sheet 146*b* is formed in a rectangular shape and one side thereof is fixed to the circumferential surface of the rotation shaft 146*a* so as to be parallel to a shaft of the rotation shaft 146*a*. When the rotation shaft 146*a* rotates, the agitating sheet 146*b* performs agitation so as to disintegrate the black toner in the toner container 140. In addition, one main surface of the agitating sheet 146*b* scoops up the agitated black toner and supplies the black toner to the auger screw 142 so as to drop from upward. The black toner supplied by the agitating supply member 146 is conveyed by the rotation of the auger screw 142 along the rotation shaft 142*a* and the conveyed black toner is discharged from the toner discharging port 141*a*.

The toner discharging port 141*a* is a rectangular opening provided at one longitudinal end at the bottom wall 140*a* of the toner container 140, and discharges the black toner conveyed by the auger screw 142 to the outside of the toner cartridge 14. The shutter 144 is a rectangular plate-shaped shutter member, which is slidably provided at a position of closing the toner discharging port 141*a*, and is configured so as to, upon attachment to the image forming apparatus 1, by receiving action of an upper end of the toner replenishing pipe 10, slidingly move against resilience of a spring, which is omitted to be illustrated, to open the toner discharging port 141*a*.

The black toner conveyed by the auger screw 142 is discharged from the toner discharging port 141*a* when the shutter 144 is in an opened state. The black toner discharged from the toner discharging port 141*a* is supplied to the developing device 6 which is a supply destination via the toner replenishing pipe 10.

A cover member 143 is disposed to be in contact with an outer circumferential part of the spiral blade 142*b* so as to cover a part of the outer circumferential part of the spiral blade 142*b* of the auger screw 142, and is able to move between a first position around the spiral blade 142*b* and a second position, which is separated from the first position, on the opposite side to the toner discharging port 141*a* across the spiral blade 142*b*. The cover member 143 is arranged at the first position when the toner cartridge 14 is not attached to the image forming apparatus 1, and after the toner cartridge 14 is attached to the image forming apparatus 1, the cover member 143 moves from the first position to the second position by the rotation of the spiral blade 142*b*.

In the embodiment, around the spiral blade 142*b*, the first position and the second position are separated from each other in an axial direction of the spiral blade 142*b*. In addition, the cover member 143 moves along the axial direction of the spiral blade 142*b* in association with the rotation of the spiral blade 142*b* after the toner cartridge 14 is attached to the image forming apparatus 1 to thereby move from the first position to the second position.

Further, in the embodiment, the cover member 143 has a plate-shaped base section 143*a* which covers a part of the spiral blade 142*b*, and a projecting section 143*b* which protrudes inwardly in a radial direction of the spiral blade 142*b* from the base section 143*a*, and to which a force along the axial direction is applied due to contact with the spiral blade 142*b* when the spiral blade 142*b* rotates. Then, a concave groove 140*c* in which one end of the base section 143*a* of the cover member 143 is inserted is formed at a side wall 140*b* of the toner cartridge 140, to which the auger screw 142 is in proximate, and the spiral blade 142*b* has a cutout 142*d* formed at a part thereof which corresponds to the projecting section 143*b* of the cover member 143 that has moved to the second position, which is positioned above the toner discharging port 141*a*.

In a state of being arranged at the first position, when the spiral blade 142*b* rotates, the cover member 143 has the projecting section 143*b* caught by the spiral blade 142*b* to move to the second position along the axial direction of the spiral blade 142*b*.

Since the spiral blade 142*b* has the cutout 142*d* formed at the part thereof which corresponds to the projecting section 143*b* of the cover member 143 that has moved to the second position, which is positioned above the toner discharging port 141*a*, the projecting section 143*b* of the cover member 143 that has moved to the second position does not become caught by the spiral blade 142*b* so that movement of the cover member 143 is stopped.

In the toner cartridge 14 according to the embodiment that is configured as described above, when the toner cartridge 14 is not attached to the image forming apparatus 1, the cover member 143 is arranged at the first position separated from the second position on the opposite side to the toner discharging port 141*a* across the spiral blade 142*b*, thus making it possible to increase capacity of the toner containing space near the toner discharging port 141*a*. As a result of this, even when the toner cartridge 14 is kept in a state of being upright with the toner discharging port 141*a* side facing downward, it is possible to suppress generation of an aggregation or a lump of the black toner near the toner discharging port 141*a*.

Further, in the toner cartridge 14 according to the embodiment, when the toner cartridge 14 is attached to the image forming apparatus 1, the cover member 143 moves from the first position to the second position on the opposite side to the toner discharging port 141*a* across the spiral blade 142*b* by the rotation of the spiral blade 142*b*. Thereby, the cover member 143 enables to suppress that the black toner existing on the upper side of the auger screw 142 in the toner container 140 flows into the toner discharging port 141*a*, thus making it possible to stabilize a quantity of the toner discharged from the toner discharging port 141*a*.

When attachment of the toner cartridge 14 to a predetermined position in the image forming apparatus 1 is completed, the shutter 144 opens the toner discharging port 141*a* completely, and the toner discharging port 141*a* and the toner replenishing pipe 10 are coupled as well as the toner containing space 145 and the toner replenishing pipe 10 are communicated with each other. Moreover, a driving gear 142*c* is coupled to a driving source in the image forming apparatus 1. Then, rotation driving force is applied from this driving source, and rotation driving about a shaft of the auger screw 142 starts. Since the cover member 143 enables to suppress that the black toner existing on the upper side of the auger screw 142 in the toner container 140 flows into the toner discharging port 141*a*, the black toner in the toner container 140 is to be discharged to the toner replenishing pipe 10 smoothly through the toner discharging port 141*a*. Thereby, the black toner is supplied as needed to the developing device 6 and the image forming operation at the image forming section 38 is carried out without delay.

When the black toner in the toner cartridge 14 runs out, the toner cartridge 14 is pulled out to be replaced with a new toner cartridge 14. When the toner cartridge 14 is pulled out, the shutter 144 is released from restriction of the toner replenishing pipe 10 and slidingly moves to an original position to close the toner discharging port 141*a*. Accordingly, at a time of working for pulling and taking out the empty toner cartridge 14, the black toner remaining in the toner cartridge 14 does not spill out from the toner discharging port 141*a* into the image forming apparatus 1.

Next, description will be given for a second embodiment of the technology. In the same manner as the first embodiment, the second embodiment will be also described by exemplifying the black toner cartridge. Since the other toner cartridges 15 to 17 are configured in the same manner as the black toner cartridge, the description thereof will be omitted below.

Figure 5A:
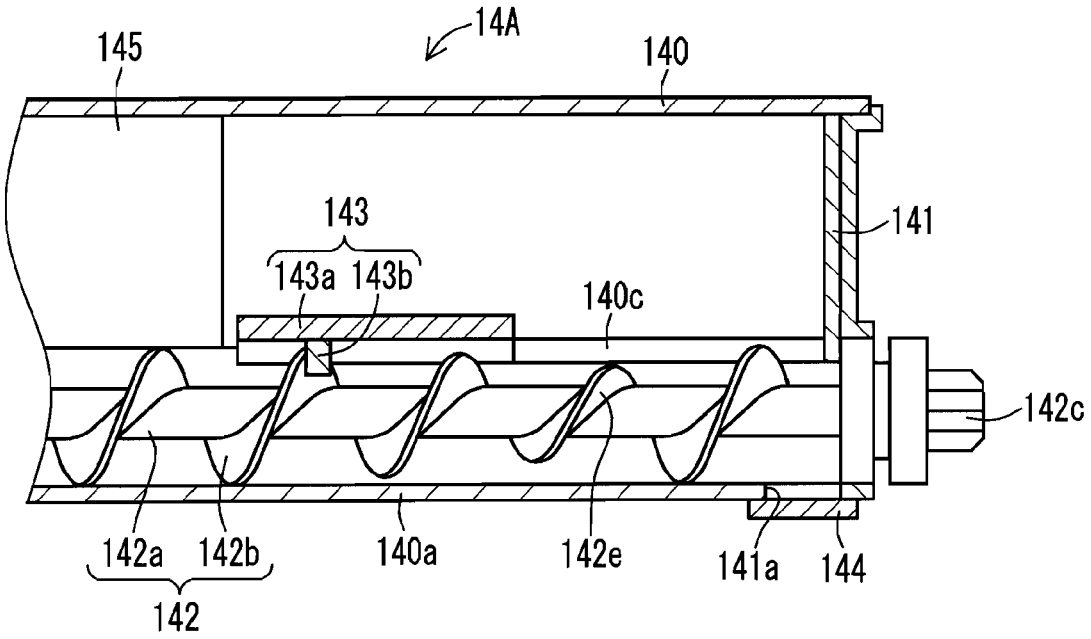
FIG. 5A and FIG. 5B are diagrams showing a configuration of a toner cartridge according to a second embodiment of the technology.
Figure 5B:
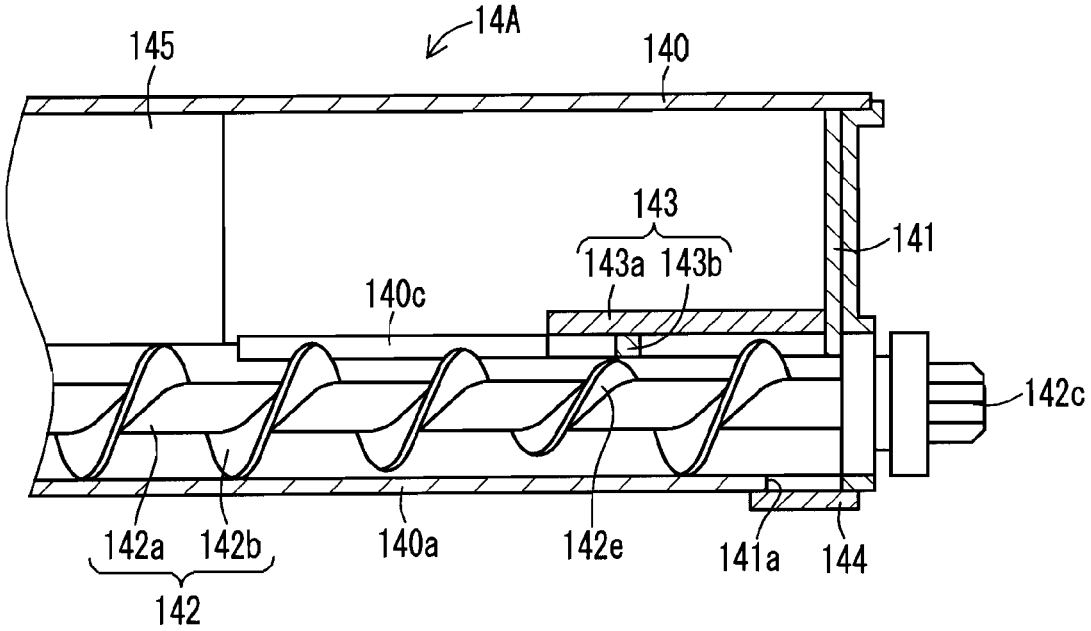

FIG. 5A and FIG. 5B are diagrams showing a configuration of a toner cartridge 14A according to the second embodiment of the technology. FIG. 5A shows a vertical cross-sectional view of the toner cartridge 14A in a state before attachment of the toner cartridge 14A to the image forming apparatus 1, and FIG. 5B shows a vertical cross-sectional view of the toner cartridge 14A in a state after attachment of the toner cartridge 14A to the image forming apparatus 1 for driving. The toner cartridge 14A of the embodiment is similar to the toner cartridge 14 according to the first embodiment described above, and the same reference numerals are assigned to corresponding parts and the description thereof will be omitted. The toner cartridge 14A is different from the toner cartridge 14 in the configuration of the spiral blade 142*b* of the auger screw 142.

In the toner cartridge 14A, the cover member 143 is provided to be in contact with the outer circumferential part of the spiral blade 142*b* so as to cover a part of the outer circumferential part of the spiral blade 142*b* of the auger screw 142, and is able to move between a predefined first position around the spiral blade 142*b* and a second position, which is separated from the first position, on the opposite side to the toner discharging port 141*a* across the spiral blade 142*b*. When the toner cartridge 14A is not attached to the image forming apparatus 1, the cover member 143 is arranged at the first position, and after the toner cartridge 14A is attached to the image forming apparatus 1, the cover member 143 moves from the first position to the second position by the rotation of the spiral blade 142*b*.

In the embodiment, the cover member 143 has the plate-shaped base section 143*a* which covers a part of the spiral blade 142*b*, and the projecting section 143*b* which protrudes inwardly in the radial direction of the spiral blade 142*b* from the base section 143*a*, and to which a force along the axial direction is applied due to contact with the spiral blade 142*b* when the spiral blade 142*b* rotates. Then, the concave groove 140*c* in which one end of the base section 143*a* of the cover member 143 is inserted is formed at the side wall 140*b* of the toner container 140, to which the auger screw 142 is in proximate, and the spiral blade 142*b* is formed so that an outer diameter of a part 142*e* thereof which corresponds to the projecting section 143*b* of the cover member 143 which has moved to the second position, which is positioned above the toner discharging port 141*a*, is smaller than an outer diameter of other part of the spiral blade 142*b*.

In a state of being arranged at the first position, when the spiral blade 142*b* rotates, the cover member 143 has the projecting section 143*b* caught by the spiral blade 142*b* to move to the second position along the axial direction of the spiral blade 142*b*.

Since the spiral blade 142*b* is formed so that the outer diameter of the part 142*e* thereof which corresponds to the projecting section 143*b* of the cover member 143 which has moved to the second position, which is positioned above the toner discharging port 141*a*, is smaller than an outer diameter of other part of the spiral blade 142*b*, the projecting section 143*b* of the cover member 143 which has moved to the second position does not become caught by the spiral blade 142*b* so that movement of the cover member 143 is stopped.

In the toner cartridge 14A according to the embodiment that is configured as described above, when the toner cartridge 14A is not attached to the image forming apparatus 1, the cover member 143 is arranged at the first position which is separated from the second position on the opposite side to the toner discharging port 141*a* across the spiral blade 142*b*, thus making it possible to increase capacity of the toner containing space near the toner discharging port 141*a*. As a result of this, even when the toner cartridge 14A is kept in a state of being upright with the toner discharging port 141*a* side facing downward, it is possible to suppress generation of an aggregation or a lump of the black toner near the toner discharging port 141*a*.

Further, in the toner cartridge 14A according to the embodiment, when the toner cartridge 14A is attached to the image forming apparatus 1, the cover member 143 moves from the first position to the second position on the opposite side to the toner discharging port 141*a* across the spiral blade 142*b* by the rotation of the spiral blade 142*b*. Thereby, the cover member 143 enables to suppress that the black toner existing on the upper side of the auger screw 142 in the toner container 140 flows into the toner discharging port 141*a*, thus making it possible to stabilize a quantity of the toner discharged from the toner discharging port 141*a*.

Next, description will be given for a third embodiment of the technology. In the same manner as the first embodiment, the third embodiment will be also described by exemplifying the black toner cartridge. Since the other toner cartridges 15 to 17 are configured in the same manner as the black toner cartridge, the description thereof will be omitted below.

Figure 6A:
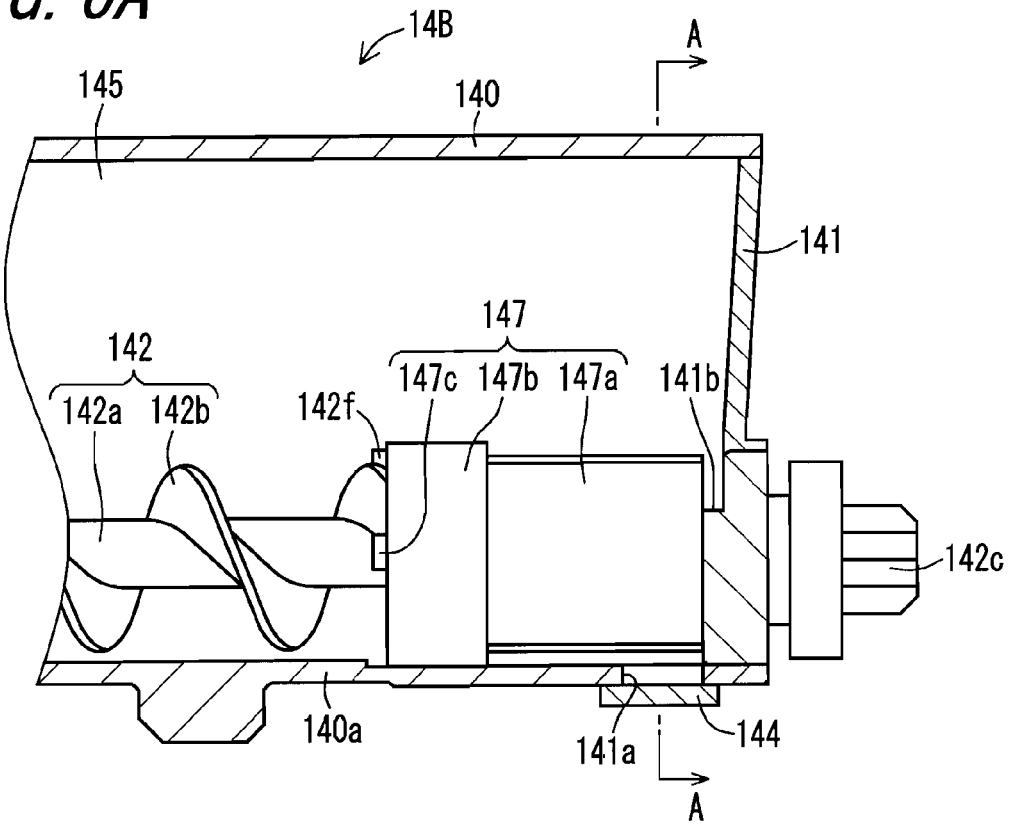
FIG. 6A and FIG. 6B are cross-sectional views of a toner cartridge according to a third embodiment of the technology in a state before attachment of the toner cartridge to the image forming apparatus.
Figure 6B:
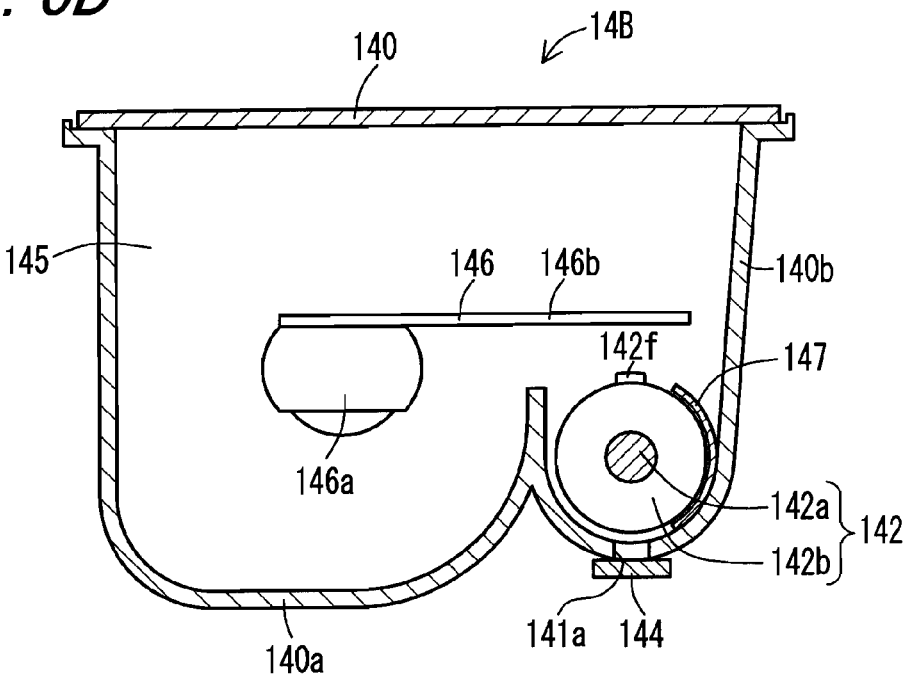
Figure 7A:
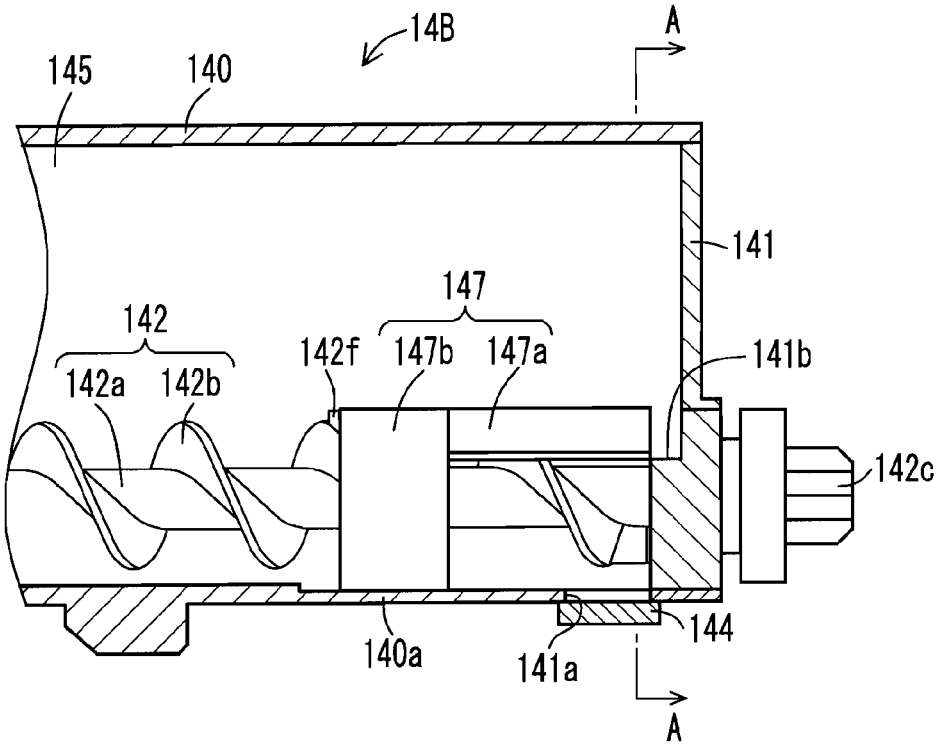
FIG. 7A and FIG. 7B are cross-sectional views of the toner cartridge in a state after attachment of the toner cartridge to the image forming apparatus for driving.
Figure 7B:
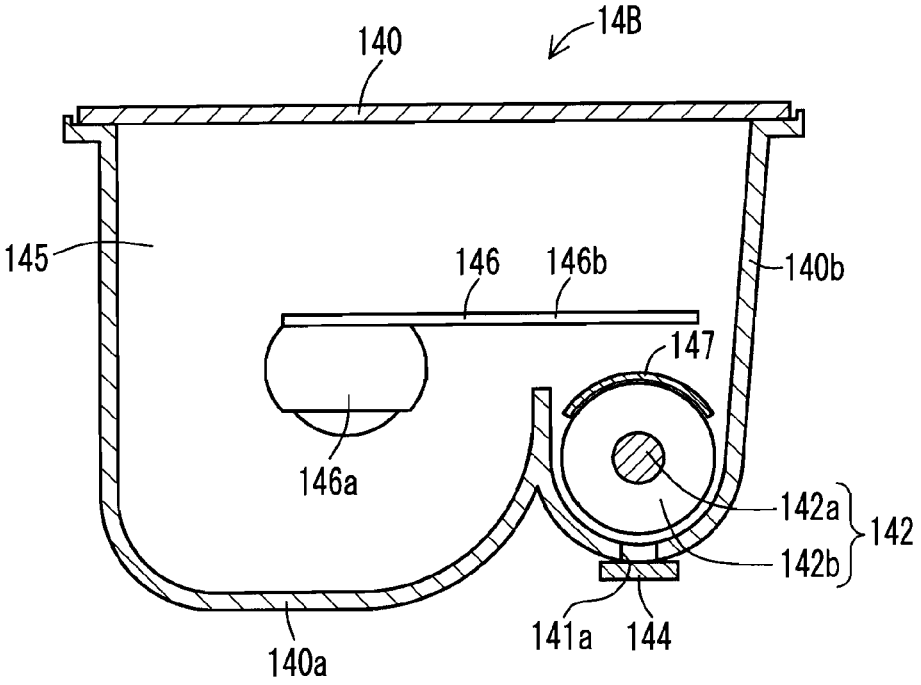
Figure 7C:
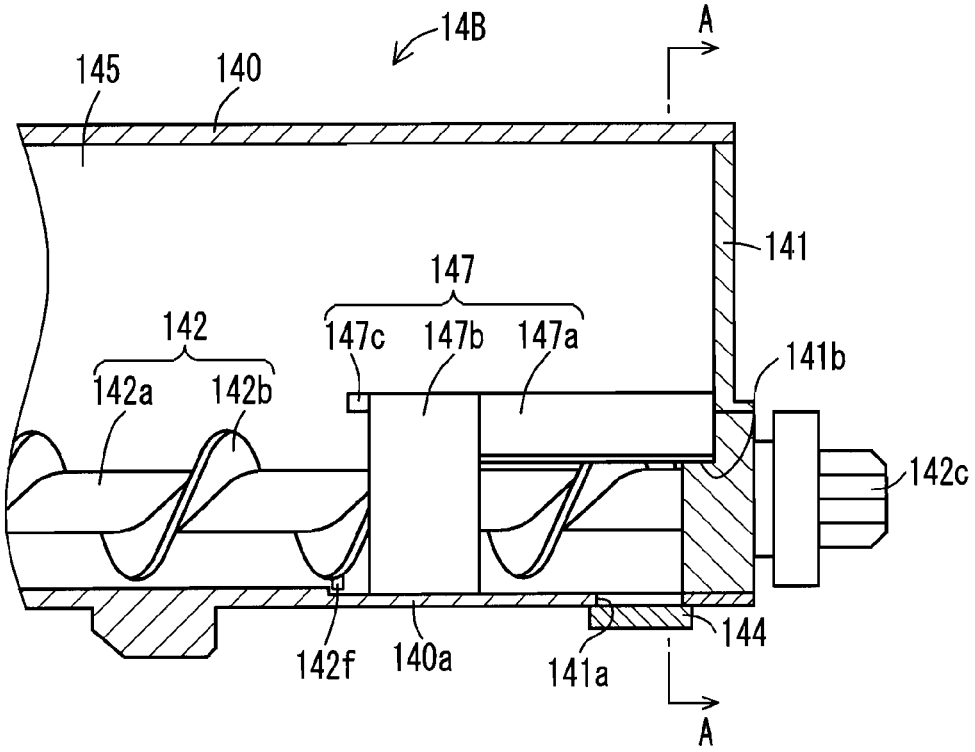
FIG. 7C and FIG. 7D are cross-sectional views of the toner cartridge in a state after attachment of the toner cartridge to the image forming apparatus for driving.
Figure 7D:
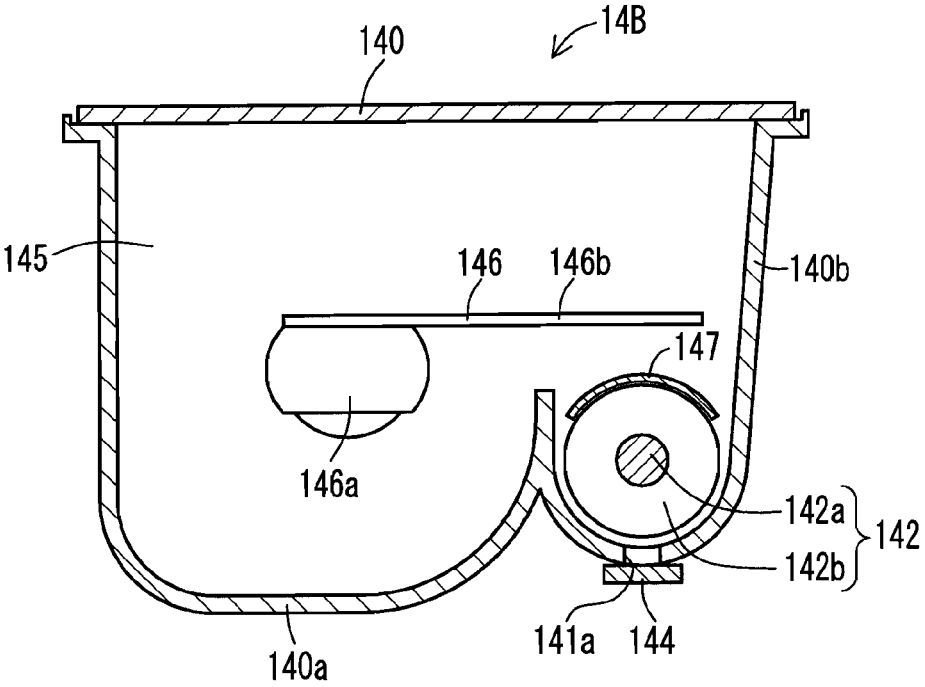
Figure 8:
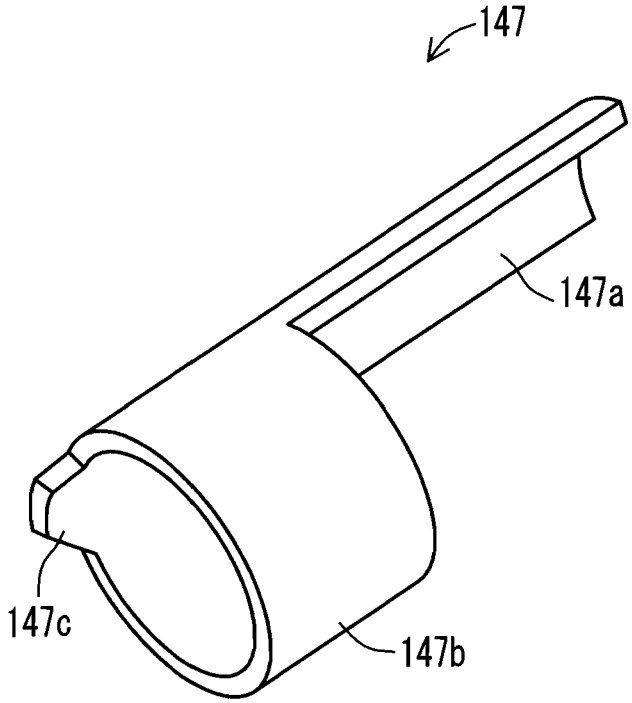
FIG. 8 is a perspective view showing a configuration of a cover member of the toner cartridge.

FIG. 6A and FIG. 6B are cross-sectional views of a toner cartridge 14B according to the third embodiment of the technology in a state before attachment of the toner cartridge 14B to the image forming apparatus 1. FIG. 6A shows a vertical cross-sectional view of the toner cartridge 14B, and FIG. 6B shows a lateral cross-sectional view taken along the line A-A of FIG. 6A. FIG. 7A, FIG. 7B, FIG. 7C and FIG. 7D are cross-sectional views of the toner cartridge 14B in a state after attachment of the toner cartridge 14B to the image forming apparatus 1 for driving. FIG. 7A and FIG. 7C show vertical cross-sectional views of the toner cartridge 14B, and FIG. 7B and FIG. 7D show lateral cross-sectional views taken along the lines A-A of FIG. 7A and FIG. 7C, respectively. FIG. 8 is a perspective view showing a configuration of a cover member 147 of the toner cartridge 14B. The toner cartridge 14B of the embodiment is similar to the toner cartridge 14 according to the first embodiment described above, and the same reference numerals are assigned to corresponding parts and the description thereof will be omitted. The toner cartridge 14B is different from the toner cartridge 14 in the configuration of the cover member 147 and the spiral blade 142*b* of the auger screw 142.

In the toner cartridge 14B, the cover member 147 is disposed to be in contact with the outer circumferential part of the spiral blade 142*b* so as to cover a part of the outer circumferential part of the spiral blade 142*b* of the auger screw 142, and is able to move between a first position around the spiral blade 142*b* and a second position, which is separated from the first position, on the opposite side to the toner discharging port 141*a* across the spiral blade 142*b*. When the toner cartridge 14B is not attached to the image forming apparatus 1, the cover member 147 is arranged at the first position, and after the toner cartridge 14B is attached to the image forming apparatus 1, the cover member 147 moves from the first position to the second position by the rotation of the spiral blade 142*b*.

In the embodiment, around the spiral blade 142*b*, the first position and the second position are separated from each other in the circumferential direction of the spiral blade 142*b*. In addition, the cover member 147 rotates in association with the rotation of the spiral blade 142*b* after the toner cartridge 14B is attached to the image forming apparatus 1 to thereby move from the first position to the second position.

Further, in the embodiment, the cover member 147 has a plate-shaped base section 147*a* that covers a part of the spiral blade 142*b*, a cylindrical section 147*b* which continues to an end of the base section 147*a* on the other longitudinal end side (the opposite side to the side where the toner discharging port 141*a* is formed) of the toner container 140 and which externally surrounds the spiral blade 142*b*, and a projecting section 147*c* that protrudes outwardly in the axial direction of the spiral blade 142*b* from the cylindrical section 147*b* to which a force along the circumferential direction is applied due to contact with the spiral blade 142*b* when the spiral blade 142*b* rotates.

Further, in the embodiment, the spiral blade 142*b* has a blade projecting section 142*f* at a part thereof which corresponds to the projecting section 147*c* of the cover member 147 disposed at the first position. Moreover, on the end wall 141 which shuts one of the opening ends on one longitudinal end side (the side where the toner discharging port 141*a* is formed) of the toner container 140, a step 141*b* is formed on which an end of the base section 147*a* in the cover member 147 which end is on a side opposite to a side of the base section 147*a* to be connected to the cylindrical section 147*b* when the cover member 147 is moved to the second position is mounted.

In a state of being arranged at the first position, when the spiral blade 142*b* rotates, the cover member 147 has the projecting section 147*c* caught by the blade projecting section 142*f* of the spiral blade 142*b* to move to the second position along the circumferential direction of the spiral blade 142*b*.

The cover member 147 that has moved to the second position along the circumferential direction of the spiral blade 142*b* slidingly moves in a direction separating from the blade projecting section 142*f* of the spiral blade 142*b* along the step 141*b* formed at the end wall 141 of the toner container 140. Thereby, the projecting section 147*c* of the cover member 147 does not become caught by the blade projecting section 142*f* of the spiral blade 142*b* so that movement of the cover member 147 is stopped.

In the toner cartridge 14B according to the embodiment that is configured as described above, when the toner cartridge 14B is not attached to the image forming apparatus 1, the cover member 147 is arranged at the first position separated from the second position on the opposite side to the toner discharging port 141*a* across the spiral blade 142*b*, thus making it possible to increase capacity of the toner containing space near the toner discharging port 141*a*. As a result of this, even when the toner cartridge 14B is kept in a state of being upright with the toner discharging port 141*a* side facing downward, it is possible to suppress generation of an aggregation or a lump of the black toner near the toner discharging port 141*a*.

Further, in the toner cartridge 14B according to the embodiment, when the toner cartridge 14B is attached to the image forming apparatus 1, the cover member 147 moves from the first position to the second position on the opposite side to the toner discharging port 141*a* across the spiral blade 142*b* by the rotation of the spiral blade 142*b*. Thereby, the cover member 147 enables to suppress that the black toner existing on the upper side of the auger screw 142 in the toner container 140 flows into the toner discharging port 141*a*, thus making it possible to stabilize a quantity of the toner discharged from the toner discharging port 141*a*.

Next, description will be given for a fourth embodiment of the technology. In the same manner as the first embodiment, the fourth embodiment will be also described by exemplifying the black toner cartridge. Since the other toner cartridges 15 to 17 are configured in the same manner as the black toner cartridge, the description thereof will be omitted below.

Figure 9:
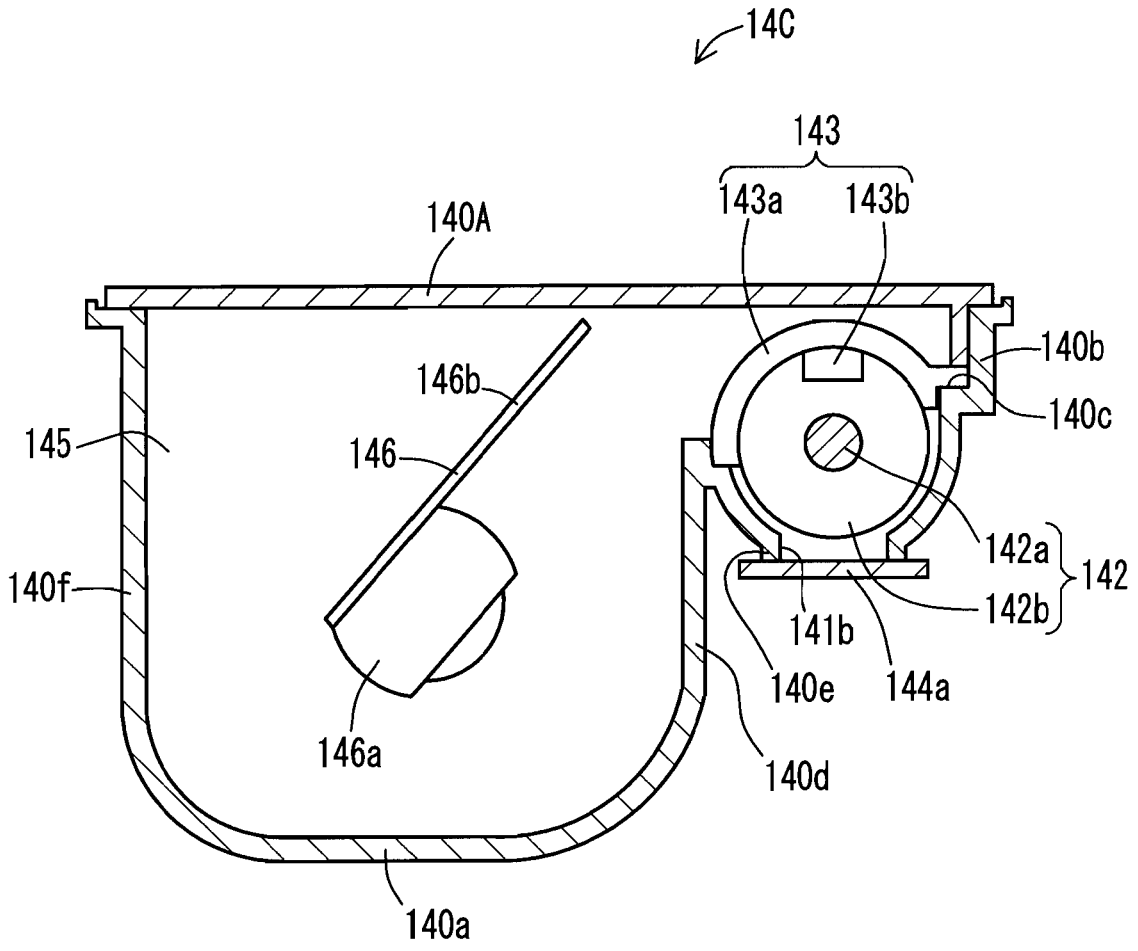
FIG. 9 is a cross-sectional view showing a configuration of a toner cartridge according to a fourth embodiment of the technology.
Figure 10:
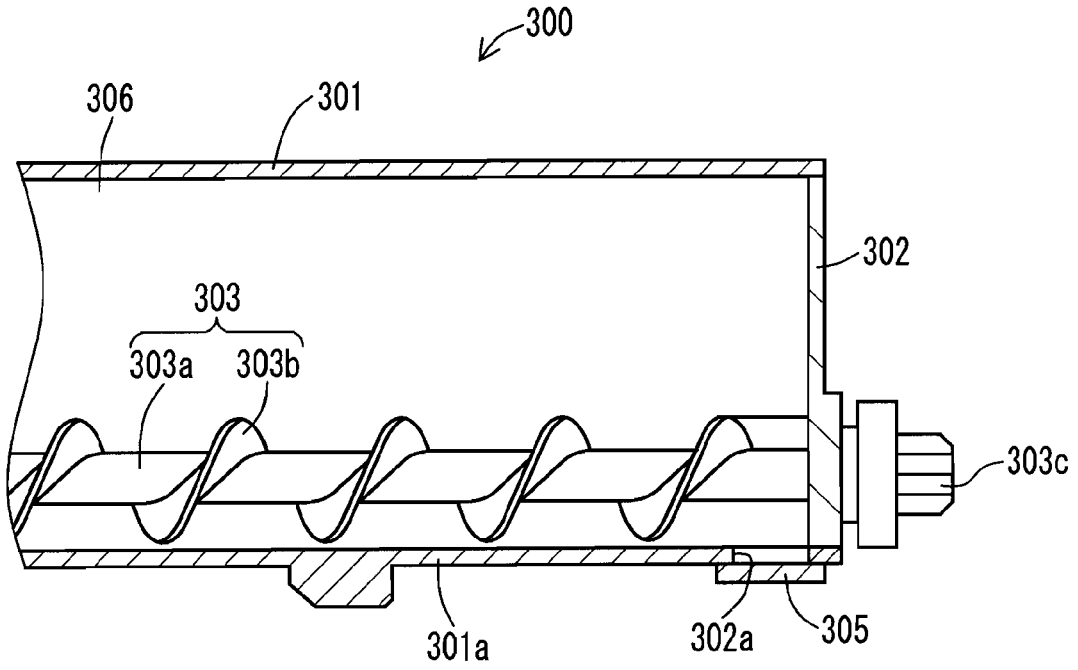
FIG. 10 PRIOR ART
FIG. 10 is a diagram showing a configuration of a toner cartridge according to the first conventional technology.
Figure 11:
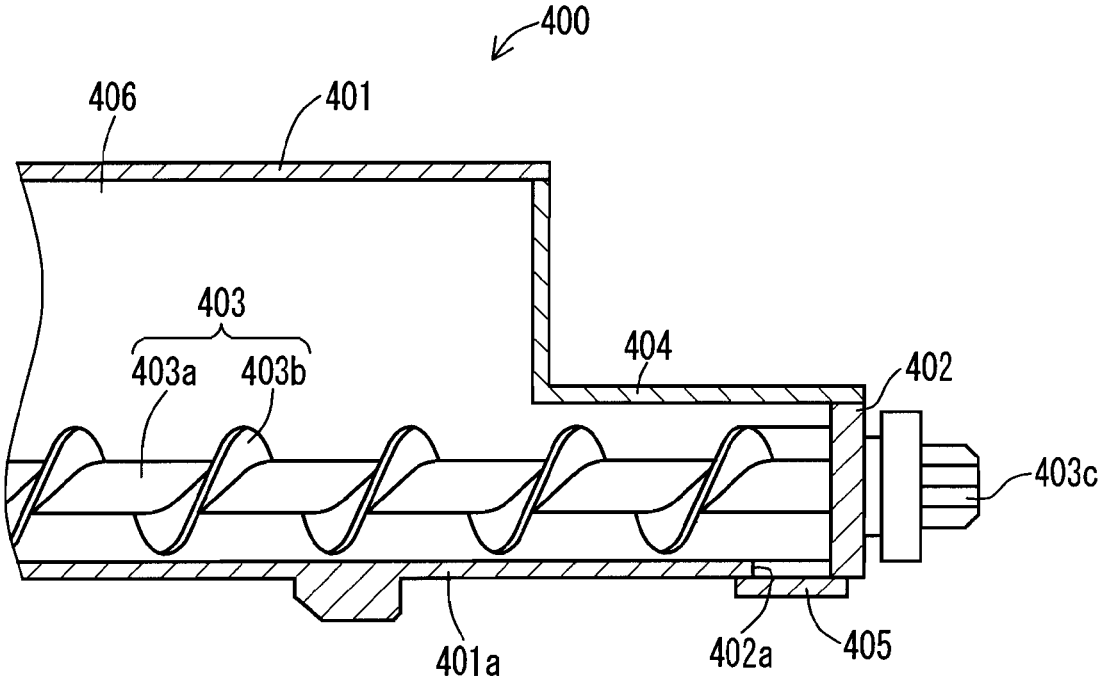
FIG. 11 PRIOR ART
FIG. 11 is a diagram showing a configuration of a toner cartridge according to the second conventional technology.

FIG. 9 is a cross-sectional view showing a configuration of the toner cartridge 14C according to the fourth embodiment. The toner cartridge 14C of the embodiment is similar to the toner cartridge 14 according to the first embodiment described above, and the same reference numerals are assigned to corresponding parts and the description thereof will be omitted. The toner cartridge 14C is different from the toner cartridge 14 in an attachment position of the cover member 143 and the auger screw 142.

The toner container 140A is a longitudinally cylindrical container and includes a first bottom wall 140*a*, a first side wall 140*b*, a second side wall 140*d*, a second bottom wall 140*e* and a third side wall 140*f*. The first bottom wall 140*a* and the first side wall 140*b* correspond to the bottom wall 140*a* and the side wall 140*b* of the toner cartridge 14 according to the first embodiment, respectively. The second side wall 140*d* is vertically disposed at one end of the first bottom wall 140 in a width direction perpendicular to the longitudinal direction. The third side wall 140*f* is vertically disposed at the other end of the first bottom wall 140 opposite to the one end thereof. The second bottom wall 140*e* is a substantially semi-cylindrical bottom wall having a downwardly convex curvature, and one end thereof is connected to an upper end of the second side wall 140*d* and the other end thereof is connected to a lower end of the first side wall 140*b*. A toner discharging port 141*b* which is a rectangular opening is provided at one longitudinal end at the second bottom wall 140*e*. The toner discharging port 141*b* is disposed above the first bottom wall 140*a*. The toner container 140A is provided with a shutter 144*a* for opening and closing the toner discharging port 141*b*. The shutter 144*a* of the embodiment has a similar configuration to the shutter 144 of the first embodiment.

In the embodiment, the cover member 143 and the auger screw 142 are disposed near the second bottom wall 140*e* of the toner container 140A. That is, the cover member 143 and the auger screw 142 are disposed at an upper portion of the toner container 140A.

In the toner cartridge 14 according to the first embodiment, since the agitating sheet 146*b* of the agitating supply member 146 can exist above the auger screw 142, the toner near the auger screw 142 is difficult to aggregate. On the other hand, in the toner cartridge 14C, since the auger screw 142 is disposed at the upper portion of the toner container 140A, no member corresponding to the agitating sheet 146*b* exists, and the toner near the auger screw 142 is prone to aggregate. The provision of the cover member of the technology makes it possible to suppress generation of the aggregation or the lump of the toner near the toner discharging port 141*b*.

Moreover, in a fifth embodiment of the technology, it is preferable that the cover members 143 included in the toner cartridge 14 according to the first embodiment, the toner cartridge 14A according to the second embodiment and the toner cartridge 14C according to the fourth embodiment, and the cover member 147 included in the toner cartridge 14B according to the third embodiment, which have been described above, are formed of a flexible material. As the flexible material, a resin such as polyethylene terephthalate (PET) is cited.

When the cover members 143 and 147 are formed of the flexible material, the projecting sections 143*b* and 147*c* of the cover members 143 and 147 that have moved to the second position on the opposite side to the toner discharging port 141*a* across the spiral blade 142*b* in association with the rotation of the spiral blade 142*b* elastically deform, even if being caught by the spiral blade 142*b*, and a force applied to the cover members 143 and 147 is relaxed, so that the cover members 143 and 147 are able to be held at the second position.

Note that, the image forming apparatus 1 is a full-color image forming apparatus in the embodiments as described above, but may be an image forming apparatus only for monochrome. Moreover, a full-color image forming system is also not limited to the exemplified tandem system, but may be another system. Further, an example in which two-component developer is used has been shown in the developing device, but the developing device may be a developing system with nonmagnetic one-component developer or the like.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner cartridge which is detachably attached to a main body of an image forming apparatus, comprising:

a toner container having a cylindrical container main body for containing toner, in the toner container a toner discharging port for discharging the toner to an outside being formed in a bottom wall at one longitudinal end thereof, and end walls for shutting opening ends of the container main body, respectively, the toner container being provided with a shutter for opening and closing the toner discharging port;

a toner conveyance member disposed inside the container main body of the toner container, the toner conveyance member extending along a longitudinal direction of the container main body, having a rotation shaft rotatably supported on the end walls and a spiral blade that encircles the rotation shaft and is fixed by the rotation shaft, and conveying the toner contained inside the container main body toward the toner discharging port by rotation of the spiral blade associated with rotation of the rotation shaft; and a cover member which is disposed inside the container main body and to be in contact with an outer circumferential part of the spiral blade so as to cover a part of the outer circumferential part of the spiral blade and which is able to move between a first position around the spiral blade at which the cover member opposes the bottom wall, and a second position, which is separated from the first position, at which the cover member opposes the toner discharging port, when the toner cartridge is not attached to the main body of the image forming apparatus, the cover member being arranged at the first position, and after the toner cartridge is attached to the main body of the image forming apparatus, the cover member moving from the first position to the second position by rotation of the spiral blade.

2. The toner cartridge of claim 1, wherein the second position is a position which is separated from the first position in an axial direction of the spiral blade around the spiral blade, and the cover member moves from the first position to the second position by moving along the axial direction of the spiral blade in association with the rotation of the spiral blade after the toner cartridge is attached to the main body of the image forming apparatus.

3. The toner cartridge of claim 2, wherein the cover member has a plate-shaped base section which covers a part of the spiral blade and a projecting section which protrudes inwardly in a radial direction of the spiral blade from the base section and, to which a force along the axial direction is applied due to contact with the spiral blade when the spiral blade rotates, and the spiral blade has a cutout formed in a part thereof which corresponds to the projecting section of the cover member which has moved to the second position.

4. The toner cartridge of claim 2, wherein the cover member has a plate-shaped base section which covers a part of the spiral blade and a projecting section which protrudes inwardly in a radial direction of the spiral blade from the base section, and to which a force along the axial direction is applied due to contact with the spiral blade when the spiral blade rotates, and an outer diameter of a part of the spiral blade which corresponds to the projecting section of the cover member which has moved to the second position is smaller than an outer diameter of other part of the spiral blade.

5. The toner cartridge of claim 1, wherein the second position is a position which is separated from the first position in a circumferential direction of the spiral blade around the spiral blade, and the cover member moves from the first position to the second position by rotating in association with the rotation of the spiral blade after the toner cartridge is attached to the main body of the image foaming apparatus.

6. The toner cartridge of claim 5, wherein the cover member has a plate-shaped base section which covers a part of the spiral blade, a cylindrical section which continues to an end of the base section on another longitudinal end side of the container main body and which externally surrounds the spiral blade, and a projecting section which protrudes outwardly in an axial direction of the spiral blade from the cylindrical section and to which a force along the circumferential direction is applied due to contact with spiral blade when the spiral blade rotates, the spiral blade has a blade projecting section formed in a part thereof which corresponds to the projecting section of the cover member disposed at the first position, and in one of the end walls which shuts one of the opening ends on one longitudinal end side of the container main body, a step is formed on which an end of the base section in the cover member which end is on a side opposite to a side of the base section to be connected to the cylindrical section when the cover member is moved to the second position is mounted.

7. The toner cartridge of claim 1, wherein the cover member is formed of a flexible material.

8. An image forming apparatus, comprising:

a photoreceptor drum on a surface of which an electrostatic latent image is to be formed;

a developing device which supplies toner to the electrostatic latent image formed on the surface of the photoreceptor drum to develop a toner image;

the toner cartridge of claim 1, the toner cartridge replenishing toner to the developing device;

a transfer device which transfers the toner image developed on the surface of the photoreceptor drum onto a recording sheet of paper; and a fixing device which fixes the transferred toner image onto the recording sheet of paper.

* * * * *